US006062139A

United States Patent [19]

Tomita et al.

[11] Patent Number: 6,062,139

[45] Date of Patent: May 16, 2000

[54] DEVICE FOR ADJUSTING INK SUPPLY GAP FOR INK FOUNTAIN APPARATUS

[75] Inventors: Yuko Tomita, Akishima; Shinsuke Taira, Oomiya, both of Japan

[73] Assignee: Tokyo Kikai Seisakusho, Ltd., Tokyo, Japan

[21] Appl. No.: 09/301,330

[22] Filed: Apr. 29, 1999

[30] Foreign Application Priority Data

Sep. 8, 1998 [JP] Japan ..... 10-269077

[51] Int. Cl.[7] ..... B41F 31/02; B41F 31/00

[52] U.S. Cl. ..... 101/365; 101/351.2

[58] Field of Search ..... 101/365, 169, 101/157, 350.1, 350.5, 350.6, 351.1–351.2, 367

[56] References Cited

FOREIGN PATENT DOCUMENTS 04345462 11/1992 Japan .
05130435 6/1993 Japan .
7-246699 9/1995 Japan .
8-230161 9/1996 Japan .

*Primary Examiner*—Kimberly Asher
*Attorney, Agent, or Firm*—Armstrong, Westerman, Hattori, McLeland and Naughton

[57] ABSTRACT

A device for adjusting an ink supply gap is employed in an ink fountain apparatus in which the bottom portion of the ink fountain apparatus forms a space for storing ink in cooperation with a peripheral surface of an ink fountain roller while a forward edge of the bottom portion faces the peripheral surface of the ink fountain roller in order to form a gap serving as an ink supply port. The device for adjusting an ink supply gap includes a plurality of blade segments and a plurality of ultrasonic linear motors corresponding to the blade segments. The blade segments are disposed on a base in a row extending in the axial direction of the ink fountain roller and are adapted to individually advance toward or retract from the ink fountain roller so as to adjust the opening of the ink supply port. The ultrasonic linear motors are adapted to individually advance or retract the corresponding blade segments.

2 Claims, 4 Drawing Sheets

DEVICE FOR ADJUSTING INK SUPPLY GAP FOR INK FOUNTAIN APPARATUS

BACKGROUND OF THE INVENTION

1. Field of the Invention

The present invention relates to a device for adjusting an ink supply gap for an ink fountain apparatus of a printing press, and more particularly to a device for adjusting an ink supply gap adapted to move blade segments toward or away from an ink fountain roller so as to adjust the width of the ink supply gap.

2. Description of the Related Art

In an ink fountain apparatus for an inking arrangement of a printing press, ink is stored in an elongated space of a substantially V-shaped cross section, which is formed by the peripheral surface of an ink fountain roller, the bottom portion of the ink fountain apparatus having its forward edge located in proximity to the peripheral surface of the ink fountain roller with an appropriate gap therebetween, and a pair of side plates, each disposed at one lateral end of the bottom portion. When the ink fountain roller is rotated, the ink stored in the elongated space is withdrawn through an ink supply port, i.e., a gap between the peripheral surface of the ink fountain roller and the forward edge of the bottom portion of the ink fountain apparatus.

To control the amount of ink withdrawn through the ink supply port, i.e., the supply of ink, the ink fountain apparatus has a blade for adjusting ink supply located at its bottom portion and a device for adjusting an ink supply gap. The device for adjusting the ink supply gap causes the blade to advance or retract so that the forward edge of the blade moves toward or away from the peripheral surface of the ink fountain roller, thereby adjusting the opening of the ink supply port.

Such conventional devices for adjusting an ink supply gap are disclosed in, for example, Japanese Patent Application Laid-Open (kokai) Nos. 7-246699 and 8-230161.

According to "Blade Adjusting Device for Ink Fountain of Printing Press" disclosed in Japanese Patent Application Laid-Open (kokai) No. 7-246699, in order to adjust the width of a gap between an ink fountain roller provided in an ink fountain of a printing press and each of a plurality of blade segments, a gap adjust device is provided for each of the blade segments. The gap adjustment device includes pushing means for continuously urging a blade segment toward its base end by means of a compression coil spring; a push rod disposed in contact with the base end of the blade segment and adapted to move the blade segment; a front cam whose support shaft is disposed in parallel with the moving direction of the blade segment and whose face moves in parallel with the moving direction of the blade segment and is in contact with the base end of the push rod; position adjustment means for moving the support shaft of the front cam axially so as to adjust the axial position of the front cam; and drive means for rotating the front cam.

In order to adjust the initial position of each blade segment, the corresponding drive means is operated to rotate the corresponding front cam until the blade segment advances to a foremost position closest to the ink fountain roller. Then, the position adjustment means is operated to axially move the support shaft of the front cam, thereby adjusting the axial position of the front cam so as to bring the forward edge of the blade segment into contact with the ink fountain roller. In this state, the position adjustment means is locked to thereby set the blade segment to its initial position.

During printing, according to the amount of ink required at a widthwise position of a printing surface, the gap between a corresponding blade segment and the ink fountain roller is adjusted in the following manner. The drive means is operated to rotate the front cam in such a direction that the blade segment moves away from the ink fountain roller. Since the pushing means pushes the blade segment toward the front cam, the forward edge of the blade segment moves from the position of contact with the ink fountain roller to an appropriate position located away from the ink fountain roller.

According to "Regulating Device for Opening of Ink Key" disclosed in Japanese Patent Application Laid-Open (kokai) No. 8-230161, in order to adjust a gap between an ink fountain roller provided in an ink fountain of a printing press and each of a plurality of ink keys (corresponding to blade segments in the present invention), a gap adjustment device is provided for each ink key. The gap adjustment device includes a first hydraulic cylinder equipped with a piston connected to an ink key; a second hydraulic cylinder connected to the first hydraulic cylinder via an oil line and serving as drive means; and a third hydraulic cylinder provided in an oil line branching from the oil line which connects the first hydraulic cylinder and the second hydraulic cylinder and serves as adjustment means.

In order to move the ink key to its initial position, where the upper forward edge of the ink key is in contact with the peripheral surface of the ink fountain roller, the second hydraulic cylinder serving as drive means is locked, and the piston of the third hydraulic cylinder serving as adjustment means is moved to thereby move the piston of the first hydraulic cylinder. As a result, the ink key connected to the piston of the first hydraulic cylinder is moved accordingly.

The third hydraulic cylinder serving as adjustment means is locked, and the piston of the second hydraulic cylinder serving as drive means is moved by a drive device to thereby move the piston of the first hydraulic cylinder by means of oil contained in the oil line. As a result, the ink key connected to the piston of the first hydraulic cylinder is moved accordingly.

Notably, the cross sectional area of the pistons increases in sequence of the piston of the third hydraulic cylinder, that of the second hydraulic cylinder, and that of the first hydraulic cylinder. According to Pascal's principle, the stroke of the piston of the first hydraulic cylinder connected to the ink key becomes very small as compared to that of the second hydraulic cylinder serving as drive means and that of the third hydraulic cylinder serving as adjustment means. Accordingly, the movement of the ink key can be finely adjusted.

The above-described conventional gap adjustment devices involve drawbacks.

Specifically, in "Blade Adjusting Device for Ink Fountain of Printing Press" disclosed in Japanese Patent Application Laid-Open No. 7-246699, a plurality of blade segments are each provided with a motor and a plurality of gears which constitute the drive means; shafts, a cam, and a push rod which constitute the position adjustment means; and a compression coil spring serving as the pushing means. Thus, a large number of parts are used, and the mechanism of the device is complex. As a result, the frequency of failure is high, and maintenance and inspection are time consuming.

Accuracy in adjusting the gap between the ink fountain roller and a blade segment cannot be improved due to the backlash between gears and the influence of machining accuracy of the cam face.

In "Regulating Device for Opening of Ink Key" disclosed in Japanese Patent Application Laid-Open No. 8-230161, each of a plurality of ink keys must be provided with hydraulic piping; thus, complex piping is involved. Further, each ink key must be provided with a plurality of hydraulic cylinders, including a cylinder for moving the ink key, a cylinder for driving the ink key, and a cylinder for adjusting the ink key. Thus, the device assumes a large-scaled configuration, resulting in an increased manufacturing cost. Also, use of hydraulic oil involves a potential for oil leakage.

SUMMARY OF THE INVENTION

An object of the present invention is to solve the drawbacks of conventional gap adjustment devices.

A device for adjusting an ink supply gap according to the present invention is employed in an ink fountain apparatus in which the bottom portion of the ink fountain apparatus forms a space for storing ink in cooperation with a peripheral surface of an ink fountain roller while a forward edge of the bottom portion faces the peripheral surface of the ink fountain roller in order to form a gap serving as an ink supply port. The device for adjusting an ink supply gap includes a plurality of blade segments and a plurality of ultrasonic linear motors corresponding to the blade segments. The blade segments are disposed on a base in a row extending in the axial direction of the ink fountain roller and are adapted to individually advance toward or retract from the ink fountain roller so as to adjust the opening of the ink supply port. The ultrasonic linear motors are adapted to individually advance or retract the corresponding blade segments.

The ultrasonic linear motor includes a stationary member attached to the base; a movable member connected to the corresponding blade segment; and a piezoelectric actuator located between the stationary member and the movable member. A pushing mechanism exerts an elastic force between the stationary member and the movable member to press the piezoelectric actuator against the movable member, thereby holding the piezoelectric actuator between the members.

The stationary member is attached to the base via a mechanism for setting the position of an origin (hereinafter called an "origin setting mechanism") capable of adjusting the position of the stationary member on the base with respect to the peripheral surface of the ink fountain roller.

In the device for adjusting an ink supply gap for an ink fountain apparatus according to the present invention, the ultrasonic linear motor which utilizes ultrasonic vibration is used as means for moving the blade segment in order to adjust the width of the ink supply gap of the ink fountain. Accordingly, the blade segment can be fed at fine pitches and can be moved very smoothly. Also, in contrast to mechanical means such as gears and screws, backlash and a like play are not involved.

Since the pushing mechanism causes the piezoelectric actuator to be pushed against the friction plate all the time, when the blade segment is to be halted at a constant position, the movable member can be securely maintained at a halt by static friction. Thus, the blade segment can be maintained at a halt at a target position without consumption of energy.

Accordingly, the width of the ink supply gap of the ink fountain can be adjusted at a high degree of accuracy, and the set ink supplying gap can be accurately maintained.

Since the movable member can be maintained at a halt at a target position without consumption of energy, the width of the ink supply gap can be maintained without consumption of energy, thus conserving energy.

Further, the use of the ultrasonic linear motor simplifies the drive mechanism, resulting in a great reduction in the number of parts. The structural simplification decreases the frequency of failure and facilitates maintenance and inspection greatly.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF PREFERRED EMBODIMENT

A device for adjusting an ink supply gap for an ink fountain apparatus according to an embodiment of the present invention will now be described with reference to the accompanying drawings.

Figure 1:
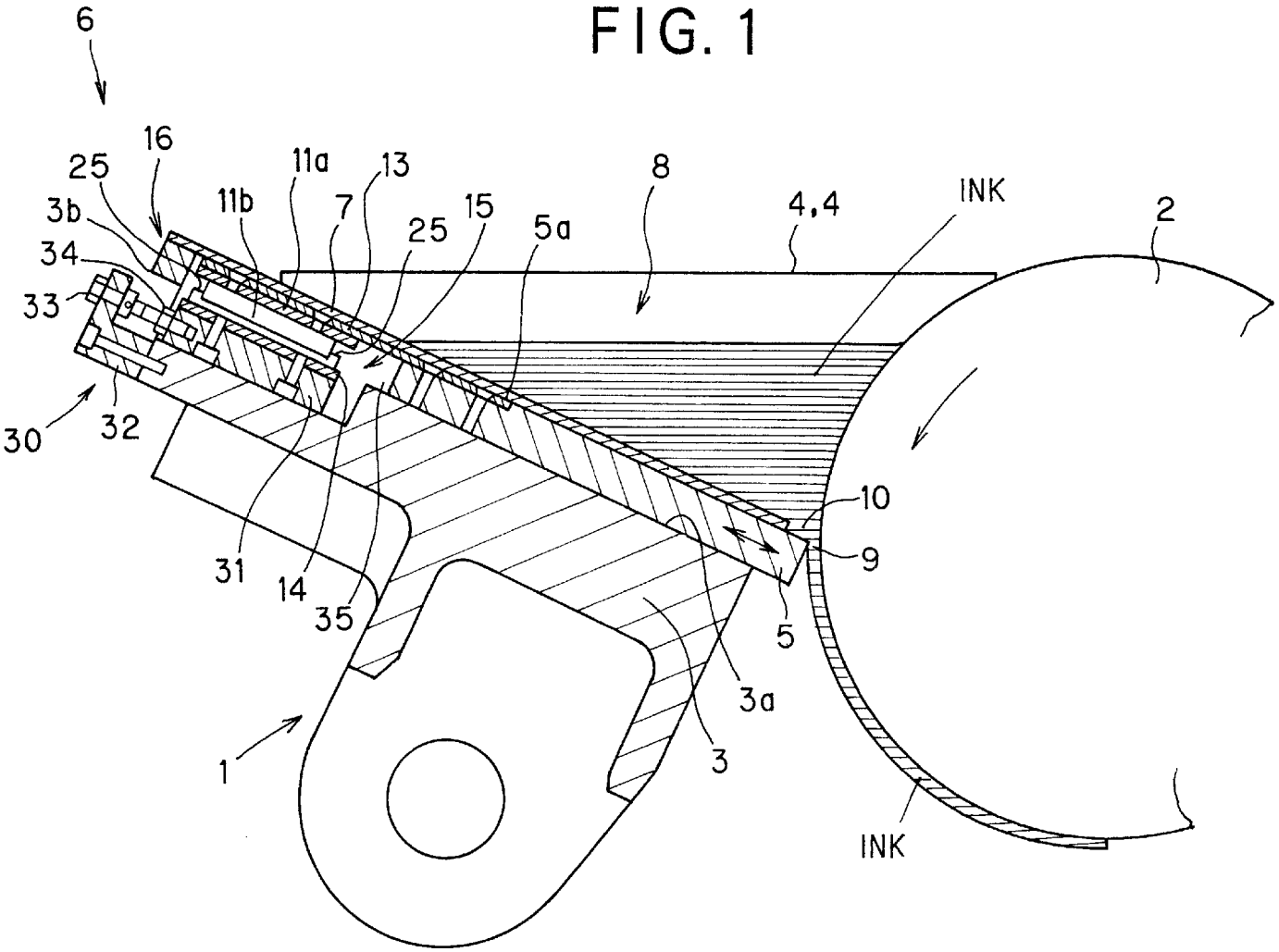
FIG. 1 is a sectional view showing an ink fountain apparatus which employs a device for adjusting an ink supply gap according to an embodiment of the present invention.

An ink fountain apparatus 1 shown in FIG. 1 is provided with a base 3 which faces an ink fountain roller 2 rotated by an unillustrated drive mechanism in the direction indicated by the arrow (in the counterclockwise direction). The front half of the base 3 has an upper surface which is stepped upward from the upper surface of the rear half of the base 3 and which forms a sloping surface 3*a* extending downward toward the ink fountain roller 2. The device for adjusting an ink supply gap is provided at the rear half of the base 3.

Figure 2:
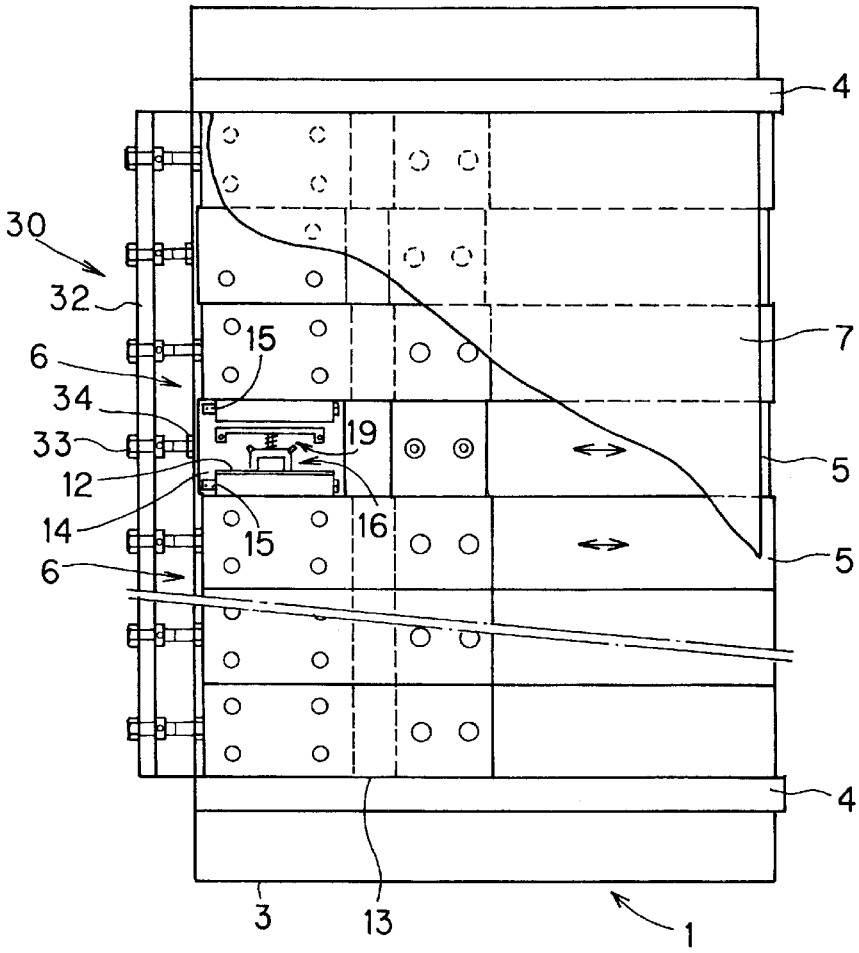
FIG. 2 is a partial sectional plan view showing the device for adjusting an ink supply gap according to the embodiment.

As shown in FIGS. 1 and 2, at both lateral ends of the base 3, a pair of side plates 4 are provided. The side plates 4 have arcuate forward edges which contact the peripheral surface of the ink fountain roller 2. A bottom plate 7 is provided between the side plates and in parallel with the sloping surface 3*a* with an appropriate gap held between the bottom plate 7 and the sloping surface 3*a*. An upper end portion of the sloping bottom plate 7 is attached to a bar 3*b* which is attached to the base 3 and extends in the axial direction of the ink fountain roller 2.

The rear half of the bottom plate 7 defines a space in cooperation with the upper surface of the rear half of the base 3. The front half of the bottom plate 7 extends forward toward the ink fountain roller 2 in parallel with the sloping surface 3*a* with the above-mentioned gap held therebetween. The lower edge of the sloping bottom plate 7 faces the peripheral surface of the ink fountain roller 2 while a small gap is formed between the lower edge and the peripheral surface. The gap between the lower edge of the sloping bottom plate 7 and the peripheral surface of the ink fountain roller 2 serves as an ink supply port 10.

A plurality of blade segments 5 adapted to adjust ink supply are inserted in the space between the sloping surface 3*a* and the bottom plate 7, and are arranged in a row extending parallel to the axis of the ink fountain roller 2 (in the direction perpendicular to the sheet of FIG. 1). The blade segments 5 are slidably guided to advance toward and retract away from the ink fountain roller 2, and their forward edges project beyond the lower edge of the sloping bottom plate 7.

The bottom plate 7, the projected forward end portions of the blade segments 5, the side plates 4, and the peripheral surface of the ink fountain roller 2 define an elongated space 8 of a substantially V-shaped cross section, in which ink is stored.

The position of each blade segment 5 is adjusted by an ultrasonic linear motor 6 which is provided for each blade segment 5 so as to move the forward edge of the blade segment 5 toward or away from the peripheral surface of the ink fountain roller 2. As a result, the opening of the ink supply port 10 between the lower edge of the sloping bottom plate 7 and the peripheral surface of the ink fountain roller 2 is adjusted. In other words, the amount of ink withdrawn is restricted by the gap between the forward edge of the upper surface of the blade segment 5 and the peripheral surface of the ink fountain roller 2, i.e., by an ink supply gap 9.

Figure 3:
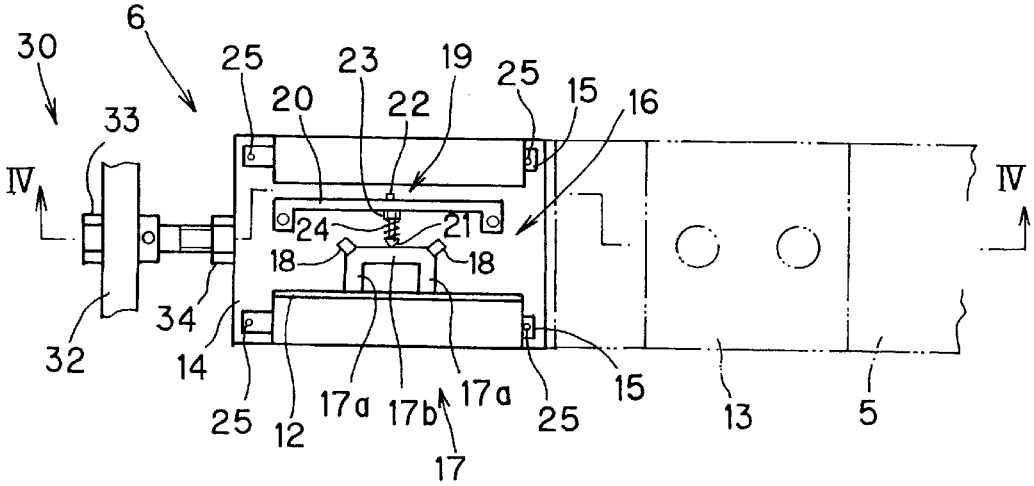
FIG. 3 is an enlarged partial view of FIG. 2.
Figure 4:
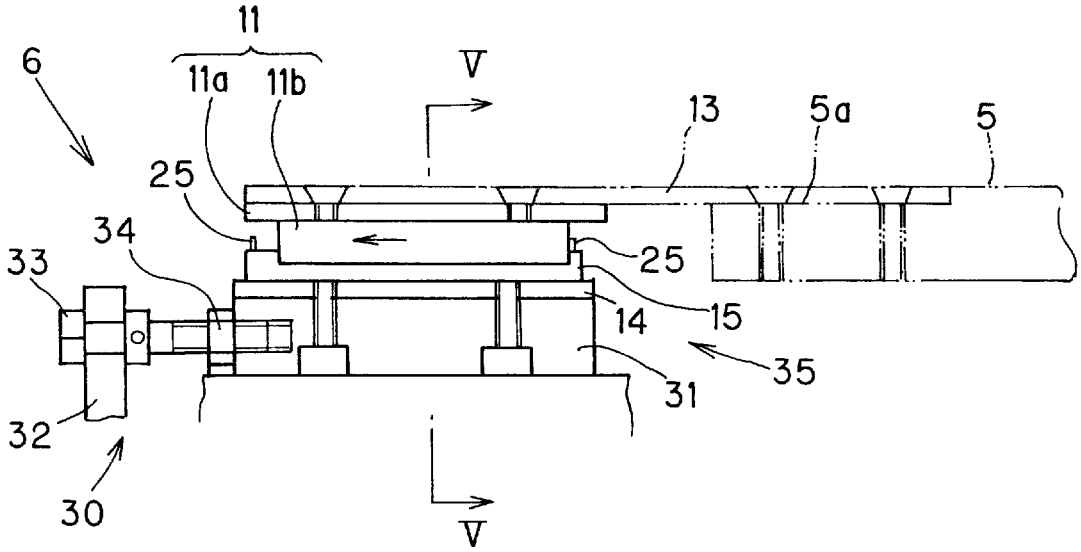
FIG. 4 is a sectional view taken along line IV—IV of FIG. 3.

As shown in FIGS. 3 and 4, the ultrasonic linear motor 6 provided for each blade segment 5 is disposed in a space 35 between the lower surface of the rear half of the bottom plate 7 and the upper surface of the rear half of the base 3 and on the upper surface of the rear half of the base 3 via an origin setting mechanism 30 provided for each blade segment 5.

An example of the ultrasonic linear motor 6 is ULSONIA MOTOR (trade name) manufactured by Sanshin Co., Ltd. The ultrasonic linear motor 6 includes the following components (1) to (5).

(1) A movable member 11 composed of a substrate ll*a* and a pair of guided elements 11*b*. The substrate 11*a* is attached onto a rear end region of the lower surface of a connection plate 13 whose front end portion is attached onto a stepped portion 5*a* formed on the upper surface of a rear end portion of the blade segment 5 and which extends into the space 35 and along the lower surface of the bottom plate 7. The guided elements 11*b* are disposed on the lower surface of the substrate 11*a* at both lateral edge positions and are shorter than the length of the substrate 11*a* as measured in the moving direction of the substrate 11*a*. (The connection plate 13 and the substrate 11*a* have a width equal to that of the blade segment 5.)

(2) A friction plate 12 attached onto the inner side surface of one of the guided elements 11*b*.

(3) A stationary member 14 mounted on a slide member 31 of the origin setting mechanism 30, which will be described later, and assuming a plate form having a width equal to that of the blade segment 5.

(4) A pair of guide elements 15 provided parallel to each other on the upper surface of the stationary member 14 and facing the guided members 11*b*. Each guide element 15 has a pair of stoppers 25 located at the front and rear end portions of the guide element 15 and supports the corresponding guided member 11*b* such that the guided member 11*b* moves while being guided by the guide element 15.

(5) A piezoelectric actuator 16 disposed between the stationary member 14 and the movable member 11 and adapted to transmit a driving force to the movable member 11 via the friction plate 12.

The piezoelectric actuator 16 will now be described. The piezoelectric actuator 16 includes an elastic body 17 and a pair of oscillators 18. The elastic body 17 has a connecting portion 17*b* and a pair of leg portions 17*a* extending from the opposite ends of the connecting portion 17*b*, thereby assuming a shape of a squarish letter U with an appropriate cross section. The oscillators 18 are attached onto both corner portions of the elastic body 17 and are connected to an unillustrated external control power unit. As will be described later, a pushing mechanism 19 pushes the piezoelectric actuator 16 against the friction plate 12 of the guided element 11*b* to thereby hold the piezoelectric actuator 16 between the pushing mechanism 19 and the friction plate 12.

Figure 5:
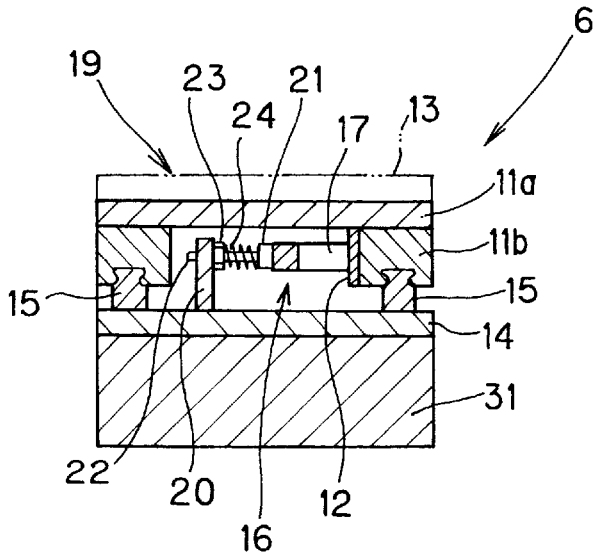
FIG. 5 is a sectional view taken along line V—V of FIG. 4.
Figure 6:
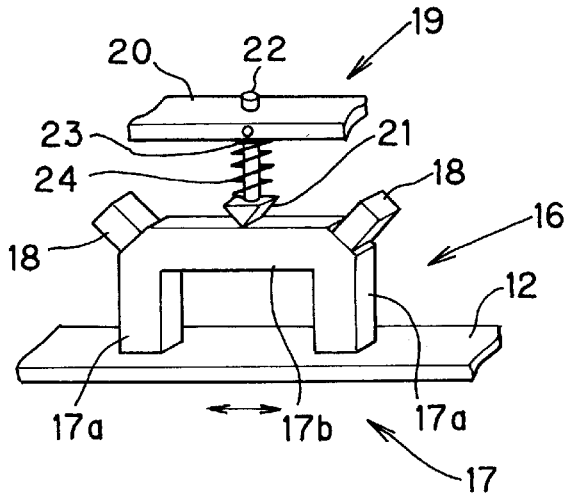
FIG. 6 is a schematic perspective view showing an ultrasonic linear motor employed in the device for adjusting an ink supply gap according to the embodiment.

As shown in FIG. 5, the pushing mechanism 19 includes a bracket 20, a screw bar 22, and a pusher 21. The bracket 20 is provided on the stationary member 14 in parallel with the friction plate 12. The screw bar 22 is fixedly attached to the bracket 20 perpendicularly to the friction plate 12. The pusher 21 is provided on the tip of the screw bar 22 in such a manner as to be movable in the axial direction of the screw bar 22. An adjustment nut 23 is screwed onto the screw bar 22 and is located between the pusher 21 and the bracket 20. A compression coil spring 24 is fitted onto the screw bar 22 and is located between the pusher 21 and the adjustment nut 23.

The spring force of the compression coil spring 24 is set through the positional adjustment of the adjustment nut 23 and causes the pusher 21 to push the connecting portion 17*b* of the piezoelectric actuator 16 toward the friction plate 12. Accordingly, the tips of both leg portions 17*a* of the piezoelectric actuator 16 are pushed against the friction plate 12.

As a result, the piezoelectric actuator 16 is held between the pusher 21 and the friction plate 12. Also, static friction is generated between the friction plate 12 and the tips of both leg portions 17*a* of the piezoelectric actuator 16 and acts on the friction plate 12 in such a manner as to restrain the movement of the movable member 11 all the time.

Figure 7:
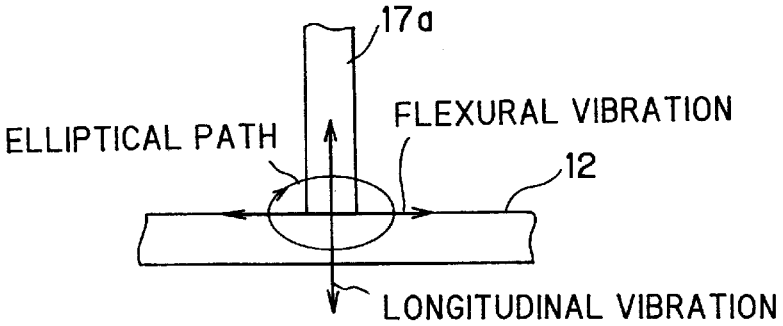
FIGS. 7 and 8 are explanatory views showing the operation of the ultrasonic linear motor of FIG. 6.

The operation of the ultrasonic linear motor 6 will now be described. When voltages having a phase difference of 90 degrees are applied to the oscillators 18 from an unillustrated external control power unit, ultrasonic vibration is generated, causing the elastic body 17 to perform stretching vibration in two directions. Specifically, in the elastic body 17, both leg portions 17*a* and the connecting portion 17*b* excite flexural vibration parallel to the moving direction of the friction plate 12 and longitudinal vibration perpendicular to the moving direction of the friction plate 12, respectively (see FIG. 7).

Figure 8:
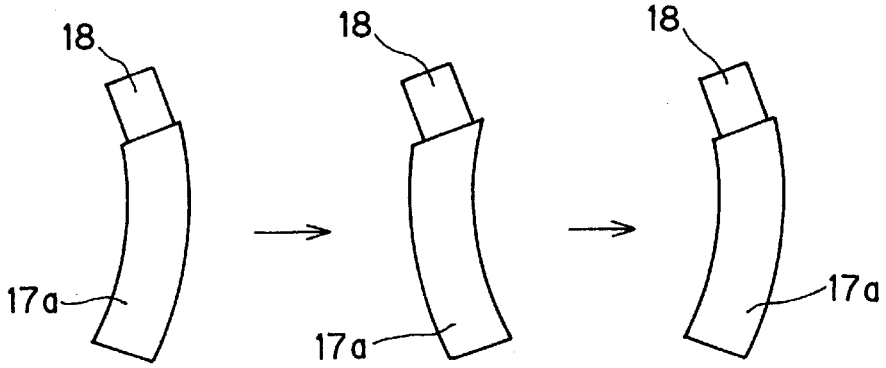

The flexural vibration and the longitudinal vibration are combined, so that the tips of both leg portions 17*a* sweep an elliptical path. In actuality, both leg portions 17*a* in contact with the friction plate 12 repeat flexure and longitudinal expansion and contraction as shown in FIG. 8.

As a result of both leg portions 17*a* repeating flexure and longitudinal expansion and contraction, the friction plate 12 and the movable member 11 are caused to move linearly along the guide element 15. Consequently, the blade segment 5 connected to the movable member 11 via the connection plate 13 approaches or retracts from the peripheral surface of the ink fountain rollers 2 at a pitch of 0.1 $\mu$m or less.

When voltages having a phase difference of −90 degrees are applied to the oscillators 18, the movable member 11 of the ultrasonic linear motor 6 moves in reverse. (Refer to, for example, "Nikkei Mechanical," No. 507 (Nikkei BP, Inc., May 26, 1997), pp. 74–79.)

The origin setting mechanism 30 is interposed between the ultrasonic linear motors 6 and the base 3 and is adapted to set each blade segment 5 to its origin where the forward edge of the upper surface of the blade segment 5 is in contact with the peripheral surface of the ink fountain roller 2, and thus the ink supply gap 9 is not formed. The origin setting mechanism 30 includes the following components (1) to (3).

(1) A plurality of slide members 31 provided movably on the upper surface of the rear half of the base 3 so as to approach or retract from the ink fountain roller 2 and having a width equal to that of the blade segment 5.

(2) A bracket 32 having an L-shaped cross section attached to the rear end surface of the base 3 and extending in the axial direction of the ink fountain roller 2.

(3) A plurality of adjustment bolts 33 which are rotatably attached to the bracket 32 in correspondence with the slide members 31, but are restrained in axial movement, and which extend in the moving direction of the slide members 31. A screw portion of each adjustment bolt 33 is screwed into a threaded hole formed in the rear end surface of each slide member 31. A lock nut 34 is screwed onto the screw portion of each adjustment bolt 33.

The operation and action of the device for adjusting an ink supply gap for the above-described ink fountain apparatus 1 will next be described.

First, each blade segment 5 is set to its origin. That is, the lock nut 34 of the origin setting mechanism 30 is loosened, and the adjustment bolt 33 is rotated so as to retreat the slide member 31. Since the ultrasonic linear motor 6 is mounted on the slide member 31 and the blade segment 5 is connected to the ultrasonic linear motor 6 via the connection plate 13, the movement of the slide member 31 causes the blade segment 5 to move accordingly.

When the forward edge of the upper surface of the blade segment 5 is retracted sufficiently away from the peripheral surface of the ink fountain roller 2, the lock nut 34 is tightened. Subsequently, the piezoelectric actuator 16 of the ultrasonic linear motor 6 is operated so that the movable member 11 and the blade segment 5 move toward the peripheral surface of the ink fountain roller 2 until the movable member 11 stops upon contact with the front stopper 25 of the guide element 15. While the movable member 11 and the blade segment 5 are at a halt, the pushing mechanism 19 secures the movable member 11 and the blade segment 5 at the stop position corresponding to the front stopper 25.

Next, the lock nut 34 of the slide member 31 is loosened, and the adjustment bolt 33 is rotated so as to move the slide member 31 toward the ink fountain roller 2.

Since the ultrasonic linear motor 6 is mounted on the slide member 31 and the blade segment 5 is connected to the ultrasonic linear motor 6 via the connection plate 13, the movement of the slide member 31 causes the blade segment 5 to move accordingly.

When the blade segment 5 moves to a position where the forward edge of the upper surface of the blade segment 5 contacts the peripheral surface of the ink fountain roller 2, i.e., when the blade segment 5 reaches its origin, rotating the adjustment bolt 33 is stopped. The lock nut 34 is tightened to fix the slide member 31.

The above-described operation for setting to the origin is performed for each of the blade segments 5.

The distance between this position of the origin and a position where the movable member 11 contacts the opposite stopper 25 corresponds to a maximum ink supplying gap 9 between the forward edge of the blade segment 5 and the peripheral surface of the ink fountain roller 2. Through adjustment of the ink supply gap 9 within this range, the amount of ink withdrawn from the ink fountain apparatus 1 is adjusted accordingly.

During printing, the piezoelectric actuators 16 of the ultrasonic linear motors 6 are operated so as to move the blade segments 5 away from the ink fountain roller 2 according to the amounts of ink required at widthwise positions of a printing surface.

Specifically, in the ink fountain apparatus 1, ink stored in the elongated space 8 is in contact with the peripheral surface of the ink fountain roller 2. When the ink fountain roller 2 is rotated in the direction of the arrow (in the counterclockwise direction) of FIG. 1, the ink is drawn from the space at a rate corresponding to the width of the gap between the forward edge of the upper surface of the corresponding blade segment 5 and the peripheral surface of the ink fountain roller 2; i.e., at a rate corresponding to the width of the ink supply gap 9. The ink drawn from the space adheres to the peripheral surface of the ink fountain roller 2 so that a film of ink is formed thereon.

When it becomes necessary to adjust the supply of ink, i.e., to adjust the ink supply gap 9, the relevant ultrasonic linear motor(s) 6 is operated. Specifically, as described previously, the piezoelectric actuator 16 is operated so that the elastic body 17 shaped in a squarish letter U, which is pushed against the friction plate 12 by the pushing mechanism 19, causes the friction plate 12 to move linearly toward or away from the peripheral surface of the ink fountain roller 2, thereby smoothly moving the movable member 11 along the guide element 15 at fine pitches.

Since the movable member 11 is connected to the blade segment 5 by means of the connection plate 13, the operation of the piezoelectric actuator 16 causes the blade segment 5 to linearly move toward or away from the peripheral surface of the ink fountain roller 2.

The movement of the blade segment 5 causes a change of the ink supply gap 9 between the forward edge of the upper surface of the blade segment 5 and the peripheral surface of the ink fountain roller 2, thereby adjusting the amount of ink withdrawn from the ink fountain apparatus 1.

Obviously, numerous modifications and variations of the present invention are possible in light of the above teachings. It is therefore to be understood that within the scope of the appended claims, the present invention may be practiced otherwise than as specifically described herein.

What is claimed is:

1. A device for adjusting an ink supply gap employed in an ink fountain apparatus in which a bottom portion of the ink fountain apparatus forms a space for storing ink in cooperation with a peripheral surface of an ink fountain roller while a forward edge of the bottom portion faces the peripheral surface of the ink fountain roller to form a gap serving as an ink supply port, said device comprising:

a plurality of blade segments disposed on a base in a row extending in the axial direction of the ink fountain roller and adapted to individually advance toward or retract from the ink fountain roller so as to adjust the opening of the ink supply port; and a plurality of ultrasonic linear motors corresponding to said blade segments and adapted to individually advance or retract the corresponding blade segments, wherein at least one of said ultrasonic linear motors comprises a stationary member attached to the base, a movable member connected to the corresponding blade segment, and a piezoelectric actuator held between the stationary member and the movable member, and an elastic member is disposed between the stationary member and the piezoelectric actuator in order to press the piezoelectric activator against a side surface of the movable member relative to a direction of advance and retraction of the movable member, thereby generating static friction between the piezoelectric actuator and the movable member.

2. A device for adjusting an ink supply gap according to claim 1, wherein the stationary member of said ultrasonic linear motor is attached to the base via an origin setting mechanism capable of adjusting the position of the stationary member on the base with respect to the peripheral surface of the ink fountain roller.

* * * * *